United States Patent [19]

Kreiselmaier

[11] Patent Number: 4,795,662

[45] Date of Patent: Jan. 3, 1989

[54] PROCESS FOR COATING TUBE PLATES AND SIMILAR PARTS OF CONDENSER, COOLERS, HEAT EXCHANGERS OR THE LIKE WITH AN ANTI-CORROSION MEDIUM

[75] Inventor: Richard Kreiselmaier, Mollens, Switzerland

[73] Assignee: Dipl.-ing. Ernst Kreiselmaier GmbH & Co Wasser, Gladbeck, Fed. Rep. of Germany

[21] Appl. No.: 47,436

[22] PCT Filed: Aug. 23, 1986

[86] PCT No.: PCT/EP86/00496

§ 371 Date: Apr. 30, 1987

§ 102(e) Date: Apr. 30, 1987

[87] PCT Pub. No.: WO87/01437

PCT Pub. Date: Mar. 12, 1987

[30] Foreign Application Priority Data

Aug. 31, 1985 [DE] Fed. Rep. of Germany ..... 3531150

[51] Int. Cl.[4] ..... B05D 7/22; F28F 13/18; F28F 19/02

[52] U.S. Cl. ..... 427/230; 165/133; 165/134.1

[58] Field of Search ..... 165/133, 134.1; 422/386, 230

[56] References Cited

U.S. PATENT DOCUMENTS 1,894,957 1/1933 Lucke et al. .

FOREIGN PATENT DOCUMENTS 2549947 2/1985 France ..... 165/133
3152899 8/1983 Fed. Rep. of Germany .
134197 7/1985 Japan .
1175157 12/1969 United Kingdom .

*Primary Examiner*—Michael Lusignan
*Attorney, Agent, or Firm*—Herbert Dubno

[57] ABSTRACT

A process is herein provided for coating tube plates found in condensers, coolers or heat exchangers, with an anti-corrosion medium. The process includes inserting plugs 5 into the ends 3 of the tubes. One or more shuttering elements 6 are then applied over the outside of the plugs 5 and in front of the tube plates 1 thereby forming an enclosed intermediate space 8 between the tube plates and the shuttering. Anti-corrosion medium is then fed into the intermediate space 8 to form a coating 9 over the tube plate 1. Upon hardening of the medium, the shuttering is removed and the plugs are pulled out from the ends of the tubes.

5 Claims, 1 Drawing Sheet

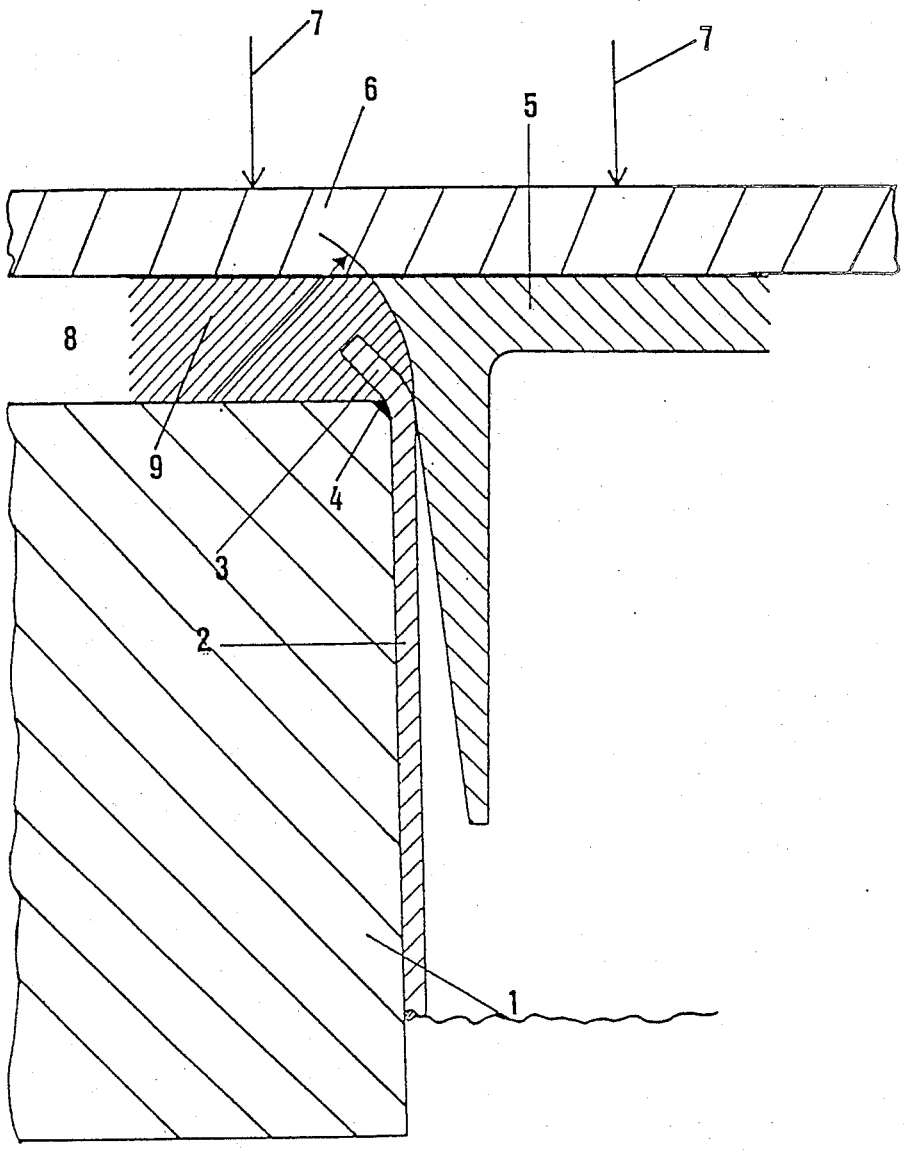
7
7
6
5
8
9
4
3
2
1

PROCESS FOR COATING TUBE PLATES AND SIMILAR PARTS OF CONDENSER, COOLERS, HEAT EXCHANGERS OR THE LIKE WITH AN ANTI-CORROSION MEDIUM

FIELD OF THE INVENTION

The invention relates to a method for coating of tube condensers, coolers, heat exchangers or the like, with an anti-corrosion medium.

BACKGROUND OF THE INVENTION

It is known to provide the tube plates of condensers, coolers, or heat exchangers with a coating of plastic material in order to protect them against corrosion. For this purpose it is necessary to expose the tube plates or the like, if this has not already been done, to enlarge the ends of the tubes imbedded therein, and to close their ends by means of plugs made of synthetic material. Around these plastic plugs, a sealing liquid is applied to the tube plates. The seal is suitable to prevent formation of corrosion craters around the tube ends of either new or already used tube plates. After these operations are completed, the anti-corrosion medium is applied by hand like a primer mass, all the way over the corks in order to insure a complete coating. After the anti-corrosion medium has hardened, it is removed by grinding in the area of the corks, so that these can be removed individually. The application of coatings of anti-corrosion medium to tube plates or the like has proven to be the best known method. Unfortunately, the method is comparatively cumbersome, and thus very expensive, to perform.

SUMMARY OF THE INVENTION

Departing from this state of the art, the invention has the object to create a process for the coating of tube sheets or the like of condensers, coolers, heat exchangers and the like with an anti-corrosion medium, by avoiding the aforementioned disadvantages. A further object of the invention is to provide a process which can be performed in a simple and rapid manner and which insures a satisfactory coating of the tube plates or the like.

These objects are attained according to the present invention through the steps of:

(a) inserting plugs into one or more ends of one or more tubes constituting a tube plate, the plugs protruding outwardly;

(b) placing a single- or multiple-element shuttering in front of the tube plate by firmly applying said shutterring to the outside of the plugs thereby forming an enclosed intermediate space between the tube plate and the shuttering;

(c) filling the intermediate space with an anti-corrosion medium to form a coating of the tube plate; and (d) removing the shuttering and pulling out the plugs from the ends of the tubes.

By this method it is possible to introduce the anti-corrosion medium into the intermediate space for the formation of the coating of the tube plates or the like, through pouring, spraying, etc, which can be accomplished in a relatively short time. Since the shuttering is pressed against the outside of the plugs, the plugs themselves do not become covered by the coating medium, so that after the removal of the shuttering, the plugs can readily be pulled out without a special grinding process.

In order to facilitate plug extraction, the plugs are provided with one or several bores, whereinto a mandrel or the like can be inserted. By carrying out the process according to the invention, a uniform, satisfactory coating can be achieved in a comparatively short time.

The tube ends can be expanded conically or in a curved manner, whereby due to the shaping of the outer contours of the plugs it is insured that the tube ends extending over the tube plate or the like are surrounded on all sides by the corrosion-prevention medium, and that optionally trumpet-shaped inlets result, which prove to be particularly advantageous from the point of view of the flow technique.

As an anti-corrosion medium an epoxy resin is used, which insures a high degree of corrosion protection.

BRIEF DESCRIPTION OF DRAWING

An embodiment example of the invention is closer explained with the aid of the drawing, which shows a sectioned top view of a marginal area of a tube end in a tube sheet, in an enlarged representation.

DETAILED DESCRIPTION

The tube sheet, of for instance a condenser, is marked with 1, therein a multitude of tubes is embedded, but only a wall of one tube 2 is illustrated.

The tubes 2 are fastened to the tube plate 1 at their ends 3 through expansion rolling. The tube plate 1 has fittings 4 at the edges surrounding the bores for receiving the tubes 2.

After expansion of the ends 3 of the tube 2, plugs 5 of synthetic material are inserted therein, which plugs extend outwardly, over the frontal edges of the ends 3 of the tubes 2.

In front of the tube plates 1, single- or multiple-element shuttering 6 are placed, namely firmly pressed against the outer side of the plug 5. For this purpose, clamping means is provided, which are indicated by arrows 7. These apply a uniform pressure on all the plugs inserted in one tube wall 1. Screw clamps, cylinder-piston units, etc, can serve as clamping means.

The single- or multiple-element shuttering 6 is built in such a manner as to form an enclosed intermediate space 8 between the outside of the tube plate 1 and the inside of the shuttering 6.

The intermediate space 8 is filled with an anti-corrosion medium, so that a coating 9 results on the outside of the tube plate. The freely protruding ends 3 of the tubes 2 extend into the coating 9, so that these are surrounded on all sides by the anti-corrosion medium.

By shaping the outside of the plugs 5 it is possible to impart the desired shape to the in- and outlets of the tubes 2, so that these can have a trumpet shaped configuration, as shown in the embodiment example.

After the hardening of the anti-corrosion medium, and thereby after the formation of the coating 9, the shuttering 6 can be removed by releasing the clamping means 7, whereafter the freely exposed plugs 5 can be easily and quickly extracted.

With the aid of the process according to the invention, it is possible to simplify and accelerate considerably the coating operation on the tube plate or the like of condensers, coolers, heat exchangers or the like, and to reduce considerably the downtime.

What is claimed is:

1. Process for coating tube plates and similar structures of condensers, coolers, heat exchangers and similar equipment, with an anti-corrosion medium, comprising the steps of:

(a) inserting plugs into one or more ends of one or more tubes constituting a tube plate, said plugs protruding outwardly;

(b) placing a single- or multiple-element shuttering in front of said tube plate by firmly applying said shutterring to the outside of said plugs thereby forming an enclosed intermediate space between the tube plate and the shuttering;

(c) filling said intermediate space with an anti-corrosion medium to form a coating of the tube plate; and (d) removing the shuttering and pulling out the plugs from the ends of the tubes.

2. Process according to claim 1, characterized in that the ends of the tubes imbedded in the tube plates are subjected to expansion.

3. Process according to claim 1, characterized in that the plugs are shaped to adjust to the requirements of the inflow conditions.

4. Process according to claim 1, characterized in that the ends of the tubes are expanded conically or in a trumpet-like shape.

5. Process according to claim 1, characterized in that an epoxy resin is used as the anti-corrosion medium.

* * * * *